US009022685B1

(12) United States Patent
Neathery et al.

(10) Patent No.: US 9,022,685 B1
(45) Date of Patent: May 5, 2015

(54) ENHANCED STRENGTH MANHOLE COVER ASSEMBLY AND FABRICATION METHOD

(71) Applicants: David L. Neathery, Shreveport, LA (US); Rober Forlong, Tampa, FL (US)

(72) Inventors: David L. Neathery, Shreveport, LA (US); Rober Forlong, Tampa, FL (US)

( * ) Notice: Subject to any disclaimer, the term of this patent is extended or adjusted under 35 U.S.C. 154(b) by 0 days.

(21) Appl. No.: 14/305,154

(22) Filed: Jun. 16, 2014

(51) Int. Cl.
*E02D 29/12* (2006.01)
*E02D 29/14* (2006.01)

(52) U.S. Cl.
CPC ..... *E02D 29/14* (2013.01); *E02D 2250/0023* (2013.01)

(58) Field of Classification Search
CPC .. E02D 29/12; E02D 29/14; E02D 2250/0023
USPC ..... 404/25; 52/19
See application file for complete search history.

(56) References Cited

U.S. PATENT DOCUMENTS

| | | | | |
|---|---|---|---|---|
| 3,401,109 | A | 9/1968 | Anderson | |
| RE29,636 | E * | 5/1978 | Gilbu | 52/20 |
| 4,548,961 | A * | 10/1985 | Rey | 523/220 |
| 4,722,976 | A | 2/1988 | Ceska | |
| 4,957,389 | A | 9/1990 | Neathery | |
| 5,098,780 | A | 3/1992 | Nemmunaitis et al. | |
| 5,114,653 | A | 5/1992 | Schuerhoff et al. | |
| 5,162,060 | A * | 11/1992 | Bredow et al. | 106/808 |
| 5,328,294 | A * | 7/1994 | Miller | 404/25 |
| 6,161,985 | A * | 12/2000 | Hinkle et al. | 404/26 |
| 6,565,935 | B1 | 5/2003 | Lohnes | |
| 6,881,768 | B2 * | 4/2005 | Rooshenas | 523/427 |
| 7,947,759 | B2 | 5/2011 | Lin et al. | |
| 8,362,113 | B2 | 1/2013 | Xing et al. | |
| 8,552,092 | B2 | 10/2013 | Xing et al. | |
| 2005/0032956 | A1 | 2/2005 | Miyoshi | |
| 2013/0274379 | A1 | 10/2013 | Turakhia | |

* cited by examiner

*Primary Examiner* — Raymond W Addie
(74) *Attorney, Agent, or Firm* — R. Keith Harrison

(57) ABSTRACT

A manhole cover assembly includes a manhole structure, a manhole frame carried by the manhole structure and a manhole frame grout cementing the manhole frame to the manhole structure. The manhole frame grout includes a grout mixture having an epoxy resin, a curing agent and an aggregate. The epoxy resin and the aggregate are present in the grout mixture in an epoxy resin:aggregate weight ratio of about 0.09. A removable manhole cover is carried by the manhole frame. A manhole cover assembly fabrication method is also disclosed.

21 Claims, 7 Drawing Sheets

ENHANCED STRENGTH MANHOLE COVER ASSEMBLY AND FABRICATION METHOD

FIELD

Illustrative embodiments of the disclosure relate to manhole structures for sewer systems. More particularly, illustrative embodiments of the disclosure relate to an enhanced strength manhole cover assembly for manhole structures and a method of fabricating an enhanced strength manhole cover assembly.

BACKGROUND

The background description provided herein is solely for the purpose of generally presenting the context of the illustrative embodiments of the disclosure. Aspects of the background description are neither expressly nor impliedly admitted as prior art against the claimed subject matter.

Manhole structures are commonly used in sewer systems to access subterranean piping in the systems. A typical manhole structure may be fitted with a manhole cover assembly having a ring-shaped manhole frame which is secured in the above-ground extending portion of the manhole structure, commonly known as a manhole chimney. A manhole cover which is seated in the manhole frame can be selectively removed there from to facilitate access to the interior of the manhole structure.

One of the problems which is frequently encountered with conventional manhole structures is that mowers tend to strike the manhole chimneys of the structures, potentially breaking and dislodging the manhole frame from the manhole chimney. Accordingly, an enhanced strength manhole cover assembly for manhole structures and a method of fabricating an enhanced strength manhole cover assembly may be desirable.

SUMMARY

Illustrative embodiments of the disclosure are generally directed to manhole cover assembly for a manhole structure. An illustrative embodiment of the manhole cover assembly includes a manhole structure, a manhole frame carried by the manhole structure and a manhole frame grout cementing the manhole frame to the manhole structure. The manhole frame grout includes a grout mixture having an epoxy resin, a curing agent and an aggregate. The epoxy resin and the aggregate are present in the grout mixture in an epoxy resin:aggregate weight ratio of about 0.09. A removable manhole cover is carried by the manhole frame.

Illustrative embodiments of the disclosure are further generally directed to a manhole cover assembly fabrication method. An illustrative embodiment of the manhole cover assembly fabrication method includes preparing a grout mixture by combining and mixing an epoxy resin, a curing agent and an aggregate, the epoxy resin and the aggregate are present in the manhole frame grout in an epoxy resin:aggregate weight ratio of about 0.09; placing a manhole frame on a manhole structure; applying the grout mixture around the manhole frame and the manhole structure; forming a manhole frame grout cementing the manhole frame to the manhole structure by curing the grout mixture; and placing a manhole cover in the manhole frame.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
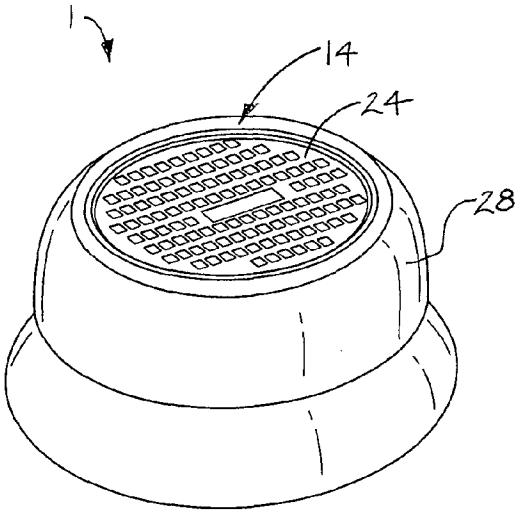
FIG. 1 is a perspective view of a manhole chimney of a manhole structure, fitted with an illustrative embodiment of the enhanced strength manhole cover assembly.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Illustrative embodiments of the disclosure are generally directed to an enhanced strength manhole cover assembly for manhole structures. The enhanced strength manhole cover assembly may include an epoxy-based manhole frame grout which cements a manhole frame to a manhole structure of a sanitary or floodwater sewer system. The manhole frame grout dramatically enhances adhesion of the manhole frame to the manhole structure. The manhole frame grout may have enhanced impact resistance characteristics which increase the resistance of the manhole frame to impact damage or shifting on the manhole structure in the event that the manhole cover assembly is inadvertently struck by a mower or other moving object.

The enhanced strength manhole cover assembly may include a manhole shoulder of the manhole structure, a manhole frame supported by the manhole shoulder and a manhole frame grout applied around the exterior of the manhole shoulder and the manhole frame to cement the manhole frame to the manhole shoulder. A removable manhole cover may be seated in the manhole frame.

The manhole frame grout may include an epoxy resin, a curing agent and an aggregate. The ratio of the epoxy resin binder to the aggregate may be optimized to maximize the impact strength and adhesion of the manhole frame grout to the typically concrete manhole structure and the typically steel manhole frame. In some embodiments, the epoxy resin and the aggregate may be present in the grout mixture in an epoxy resin:aggregate weight ratio of about 0.09.

In some embodiments, the epoxy resin of the manhole frame grout may include bisphel A epoxy, bisphenol F epoxy and 1,4-butanediol diglycidyl ether. The bisphel A epoxy, the bisphenol F epoxy and the 1,4-butanediol diglycidyl ether may be present in the epoxy resin in percentages by weight of about 57.4%, about 24.6% and about 18%, respectively.

In some embodiments, the curing agent in the manhole frame grout may include a modified polyamine. The modified polyamine may have an amine value of about 540-600 and a viscosity of about 150 MPas.

In some embodiments, the aggregate in the manhole frame grout may include graded silica and fly ash. The graded silica and the fly ash may be present in the aggregate in percentages by weight of about 85% and about 15%, respectively. The aggregate may include about 80% by weight full grain silica, about 15% by weight fly ash and about 5% silica flour. An example of a manhole frame grout which is suitable for fabrication of the manhole cover assembly is the DINJER (trademark) Ring Guard Grout-Pak available from WBE Dorcas, Inc. (www.wbedorcas.com).

Illustrative embodiments of the disclosure are further generally directed to a manhole cover assembly fabrication method. An illustrative embodiment of the manhole cover assembly fabrication method may include preparing a grout mixture by combining and mixing an epoxy resin, a curing agent and an aggregate; seating a manhole frame on the manhole shoulder of a manhole structure applying the grout mixture around the exterior of the manhole frame and the manhole shoulder; forming a manhole frame grout cementing the manhole frame to the manhole shoulder by curing the grout mixture; and placing a manhole cover in the manhole frame. The epoxy resin and the aggregate may be present in the grout mixture in an epoxy resin:aggregate weight ratio of about 0.09.

In some embodiments, preparing the grout mixture may include combining and mixing about 8.75% by weight of the epoxy resin, about 3.25% by weight of the curing agent and about 87.87% by weight of the aggregate. The epoxy resin may include bisphel A epoxy, bisphenol F epoxy and 1,4-butanediol diglycidyl. The epoxy resin may include bisphel A epoxy, bisphenol F epoxy and 1,4-butanediol diglycidyl ether in percentages by weight of about 57.4%, about 24.6% and about 18%, respectively.

In some embodiments, preparing the grout mixture may include combining and mixing a curing agent including a modified polyamine having an amine value of about 540-600 and a viscosity of about 150 MPas with the epoxy resin and the aggregate.

In some embodiments, preparing the grout mixture may include combining and mixing an aggregate including graded silica and fly ash with the epoxy resin and the curing agent.

In some embodiments, preparing the grout mixture may include combining and mixing an aggregate including a graded silica and fly ash present in the aggregate in percentages by weight of about 85% and about 15%, respectively, with the epoxy resin and the curing agent.

In some embodiments, preparing the grout mixture may include combining and mixing an aggregate including about 80% by weight full grain silica, about 15% by weight fly ash and about 5% silica flour with the epoxy resin and the curing agent.

In some embodiments, the manhole cover assembly fabrication method may include preparing the surfaces of a manhole structure and a manhole frame; preparing a manhole frame grout; placing the manhole frame on the manhole structure; applying the manhole frame grout around the exterior of the manhole frame and the manhole structure; curing the manhole frame grout; and placing a manhole cover in the manhole frame.

In some embodiments, preparing the manhole frame grout may include preconditioning the epoxy resin, the curing agent and the aggregate components; forming a primary grout mixture by combining and mixing the epoxy resin component and the curing agent component; and forming a secondary grout mixture by combining and mixing the aggregate component with the primary grout mixture.

Figure 2:
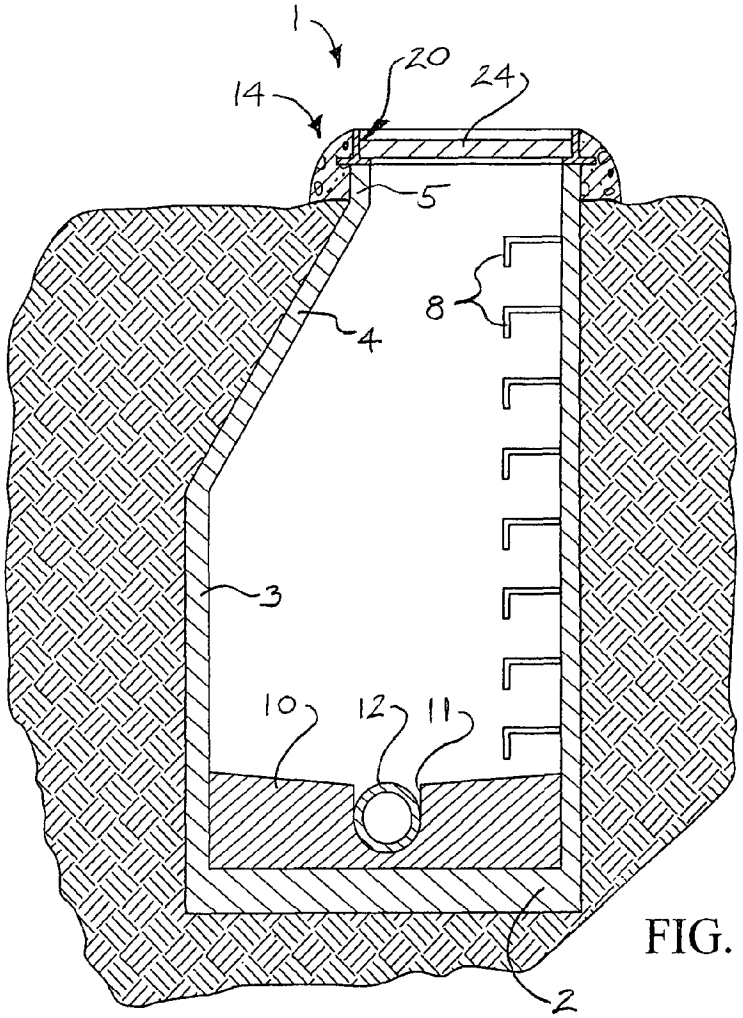
FIG. 2 is a vertical sectional view of a manhole structure fitted with an illustrative embodiment of the enhanced strength manhole cover assembly.
Figure 3:
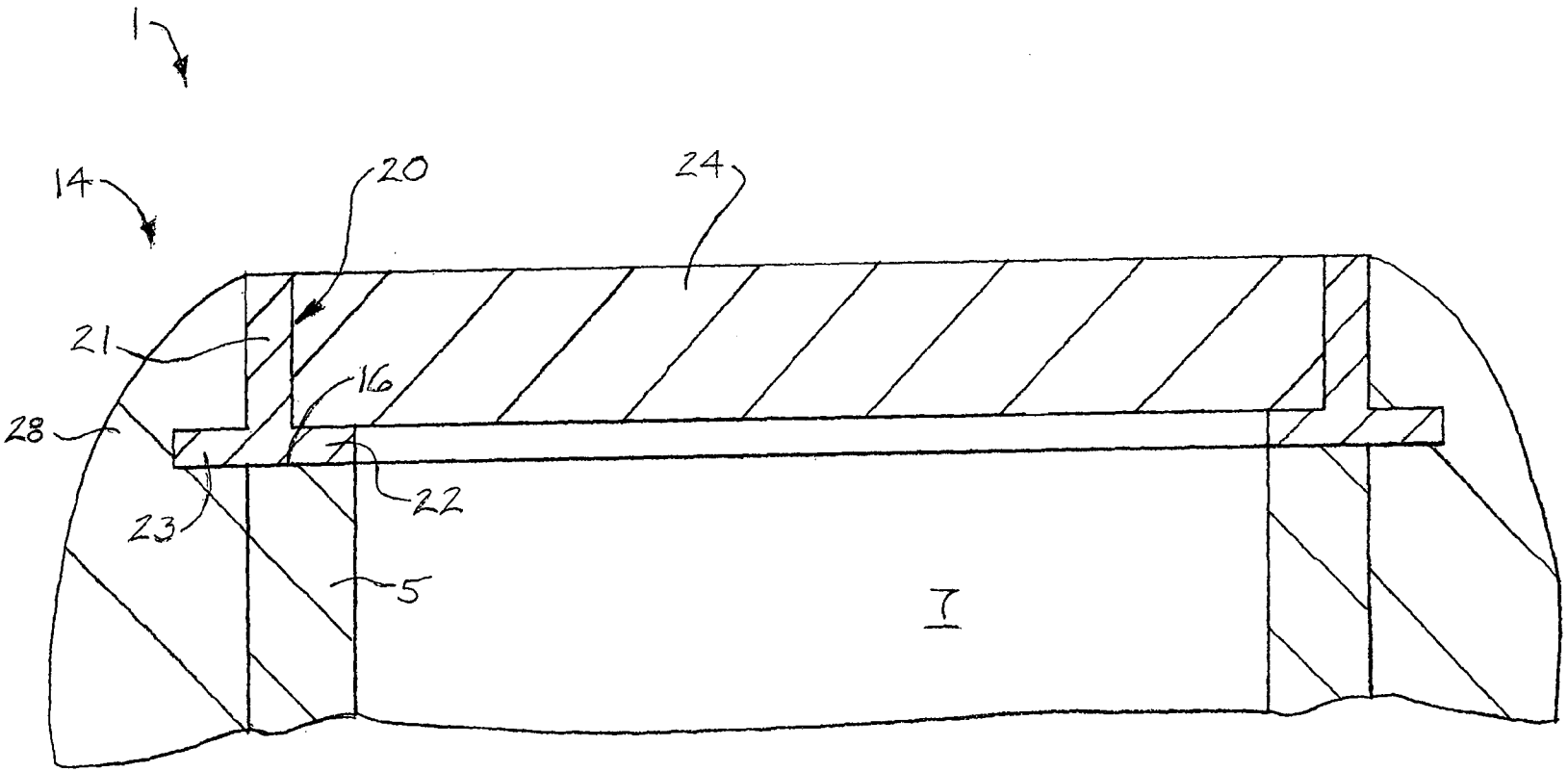
FIG. 3 is an enlarged sectional view of the illustrative enhanced strength manhole cover assembly.

Referring initially to FIGS. 1-3 of the drawings, a typical manhole structure 1 which is fitted with an illustrative embodiment of the enhanced strength manhole cover assembly 14 is illustrated. The manhole structure 1 may be part of a sanitary or floodwater sewer system (not illustrated) and, as illustrated in FIG. 2, may include a base 2, a barrel section 3 extending from the base 2 and a cone section 4 extending from the barrel section 3. The base 2, the barrel section 3 and the cone section 4 may extend beneath the ground 30. A manhole chimney 5 may extend from the cone section 4 above the ground 30. Multiple steps 8 may extend from the barrel section 3 and the cone section 4 into the manhole structure interior 7 of the manhole structure 1.

A bench 10 may be provided on the base 2 in the manhole structure interior 7 of the manhole structure 1. A channel 11 may extend into and along the bench 10. A wastewater conduit 12 may be seated in the channel 11. The wastewater conduit 12 may carry wastewater (not illustrated) from a residence or business to a wastewater treatment facility such as in the conventional manner.

The manhole cover assembly 14 is provided on the manhole chimney 5. The manhole cover assembly 14 provides access to the manhole structure interior 7 for cleaning, repair, replacement and maintenance of the wastewater conduit 12, the inlet and outlet pipe connections (not illustrated) which interface with the wastewater conduit 12 and the structural components of the manhole structure 1. As illustrated in FIG. 3, the manhole cover assembly 14 may include an annular manhole shoulder 16 on the manhole chimney 5. An annular manhole frame 20 includes a manhole frame wall 21 and a manhole cover support flange 22 which protrudes circumferentially inwardly from the manhole frame wall 21 and is seated on the manhole shoulder 16. A manhole frame flange 23 may extend circumferentially outwardly from the manhole frame wall 21. A manhole frame grout 28 is applied around the exterior of the manhole frame 20 and the manhole chimney 5 and cements the manhole frame 20 on the manhole shoulder 16. The manhole frame grout 28 enhances impact resistance of the manhole cover assembly 14 and resistance of the manhole frame 20 to shifting on the manhole shoulder 16 in the event that the manhole chimney 5 is inadvertently struck by a mower (not illustrated) or by some other moving object.

Figure 4:
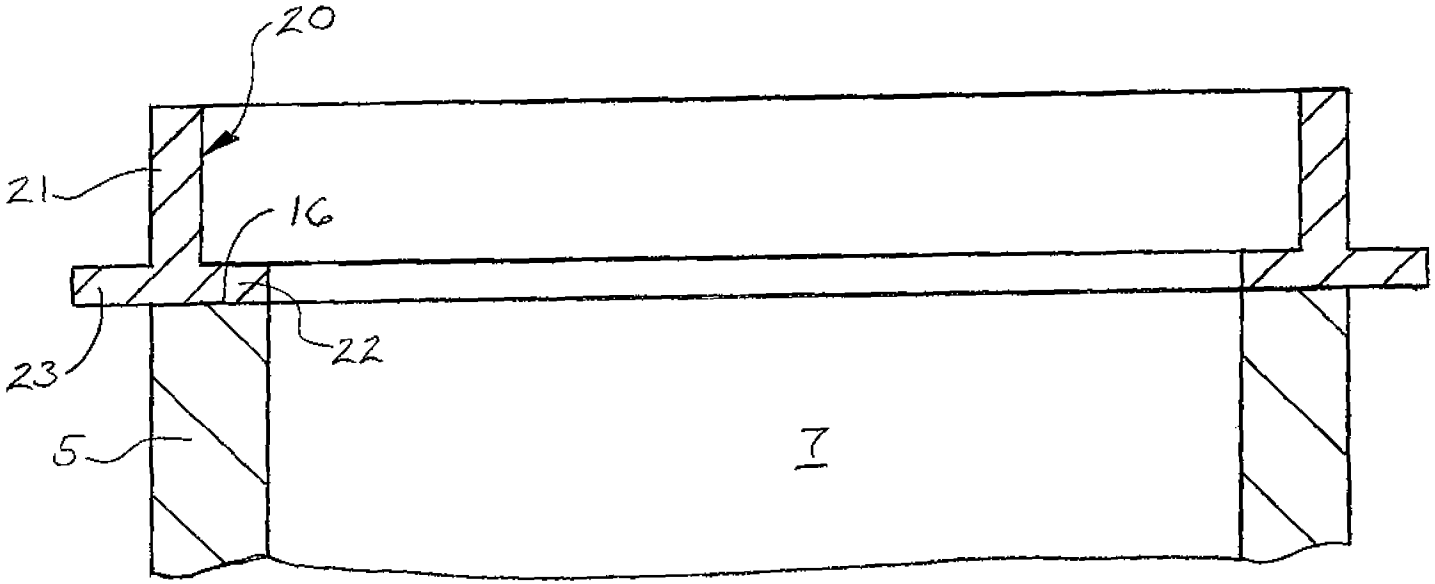
FIG. 4 is an enlarged sectional view of the manhole chimney of the manhole structure prior to installation of the enhanced strength manhole cover assembly.
Figure 5:
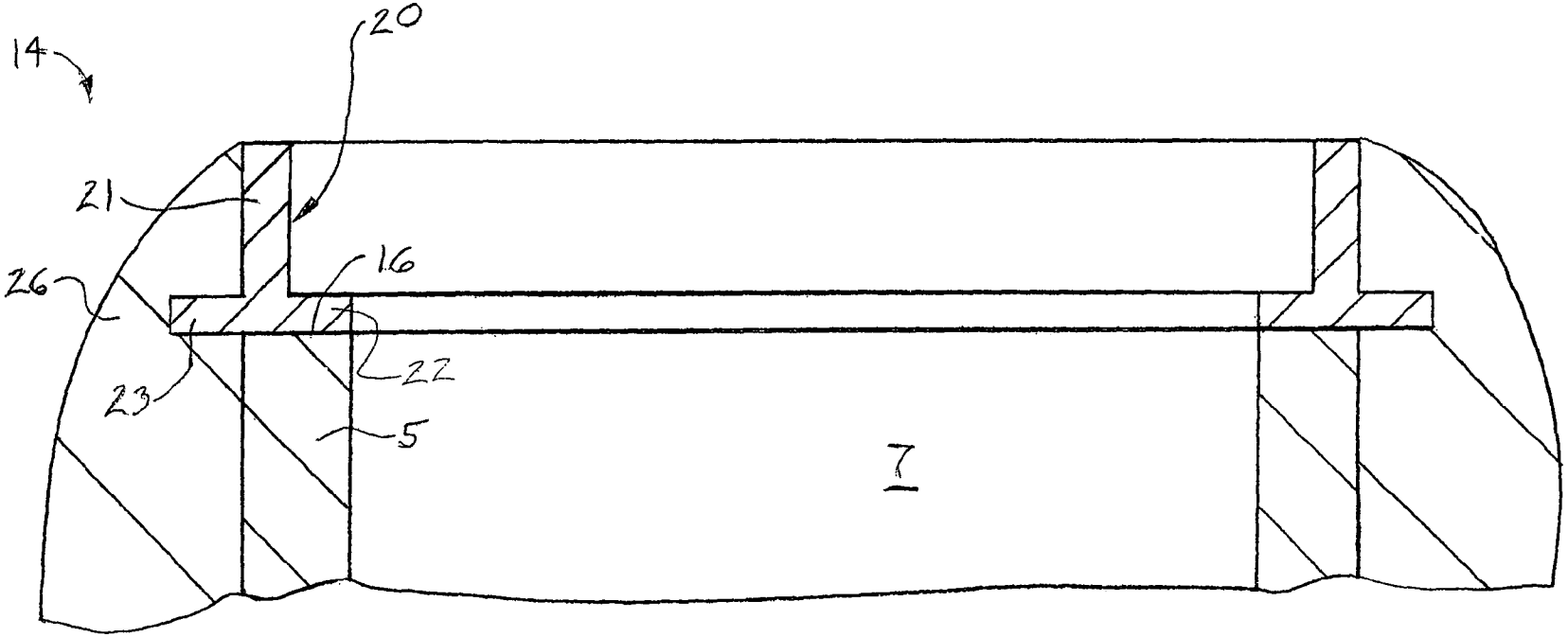
FIG. 5 is an enlarged sectional view of the manhole chimney after application of manhole frame grout in installation of the enhanced strength manhole cover assembly.
Figure 6:
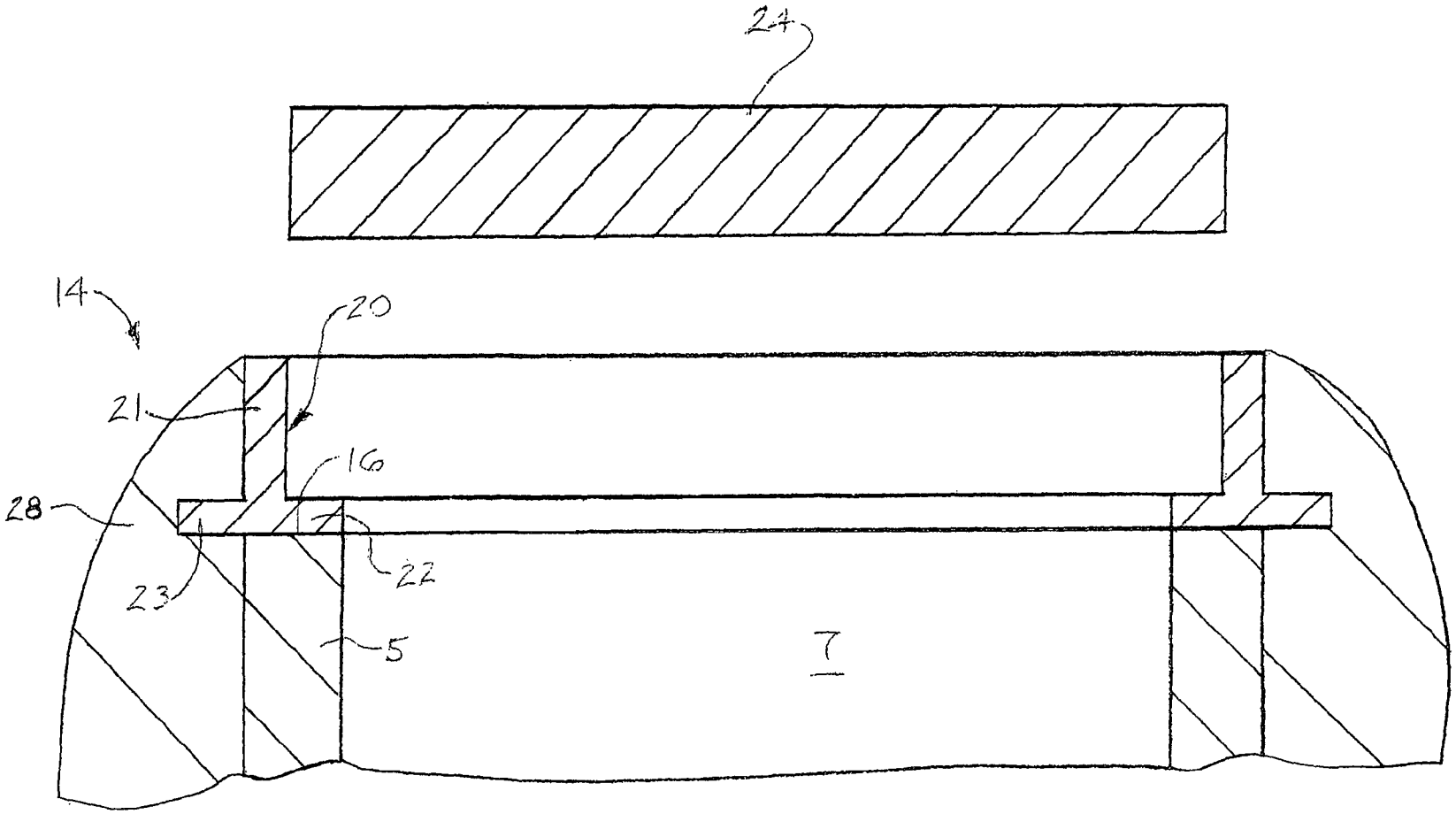
FIG. 6 is an enlarged exploded sectional view of the illustrative enhanced strength manhole cover assembly with a manhole cover removed from the assembly.

Referring next to FIGS. 4-6 of the drawings, typical fabrication of the manhole cover assembly 14 in the manhole structure 1 may be as follows. As illustrated in FIG. 4, the manhole frame 20 and the manhole chimney 5 may initially be prepared for subsequent application of the manhole frame grout 28 (FIG. 6) to the exterior of the manhole frame 20 and the manhole chimney 5. The manhole frame 20 and the manhole chimney 5 should be clean, sound and free of moisture.

Dust, laitance, oils, grease, curing compounds and any foreign substances which could otherwise interfere with adhesion of the manhole frame grout 28 thereto should be removed typically using mechanical means such as sandblasting, grinding, bush hammering and wire brushing, for example and without limitation. The surfaces may be sandblasted for maximum adhesion of the manhole frame grout 28.

An example of a manhole frame grout 28 which is suitable for fabrication of the manhole cover assembly 14 is the DINJER (trademark) Ring Guard Grout-Pak available from WBE Dorcas, Inc. (www.wbedorcas.com). In preparation of the manhole frame grout 28, the epoxy resin, the curing agent and the aggregate components may initially be preconditioned to 70° F. for 24 hours before mixing and application. The epoxy resin and the curing agent may be added to a suitable mixing vessel (not illustrated) and mixed for about 2 minutes to form a primary grout mixture. The aggregate may then be added to the primary grout mixture and mixed for about 3 minutes to form a secondary grout mixture 26. As illustrated in FIG. 5, the secondary grout mixture 26 may then be applied to the exterior of the manhole frame 20 and the manhole chimney 5 using a suitable grout application implement (not illustrated).

As illustrated in FIG. 6, manhole cover support flange 22 after the secondary grout mixture 26 (FIG. 5) cures, the manhole frame grout 28 cements the manhole frame 20 on the manhole chimney 5. A manhole cover 24 may be seated on the manhole cover support flange 22 in the manhole frame 20 to close the manhole structure interior 7. Thus, the manhole cover 24 can be readily unseated and removed from the manhole frame 20 to provide access to the manhole structure interior 7 for cleaning, repair, replacement and maintenance of the wastewater conduit 12 (FIG. 2) and the inlet and outlet pipe connections (not illustrated) which interface with the wastewater conduit 12 as well as the interior structural components of the manhole structure 1. It will be appreciated by those skilled in the art that the manhole frame grout 28 significantly enhances adhesion of the manhole frame 20 to the manhole structure 1 as well as strengthens the impact resistance of the manhole cover assembly 14 and prevents shifting or displacement of the manhole frame 20 on the manhole shoulder 16 in the event that the manhole cover assembly 14 is inadvertently struck by a moving object such as a mower (not illustrated) as grass growing adjacent to the manhole structure 1 is mowed.

Figure 7:
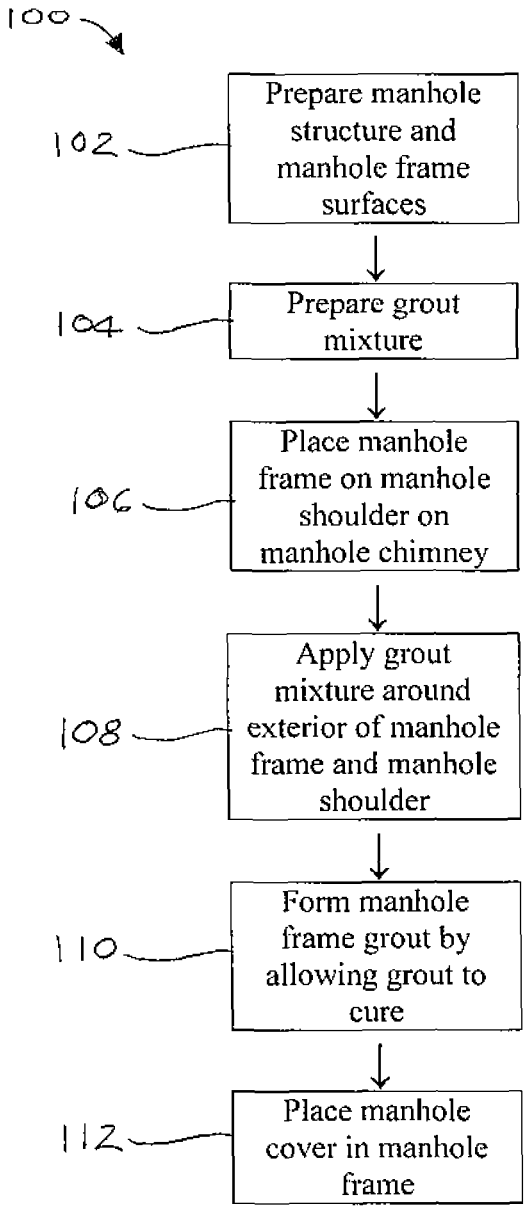
FIG. 7 is a flow diagram of an illustrative embodiment of the enhanced strength manhole cover assembly fabrication method.

Referring next to FIG. 7 of the drawings, a flow diagram of an illustrative embodiment of the enhanced strength manhole cover assembly fabrication method is generally indicated by reference numeral 100. At block 102, a manhole structure and manhole frame surfaces on a manhole frame may be prepared to render the surfaces which are to be cemented clean, sound and free of moisture for maximum adhesion of the manhole frame grout to the manhole structure and manhole frame surfaces. Typical methods of preparing the surfaces may include mechanical means such as sandblasting, grinding, bush hammering and wire brushing, for example and without limitation.

At block 104, a grout mixture may be prepared. The grout mixture may be prepared using the components and methods which were heretofore described. At block 106, the manhole frame may be placed on the manhole shoulder on the manhole chimney of the manhole structure. At block 108, the grout mixture may be applied around the exterior of the manhole frame and the manhole shoulder At block 110, a manhole frame grout may be formed by curing the grout mixture. At block 112, a manhole cover may be placed in the manhole frame.

Figure 8:
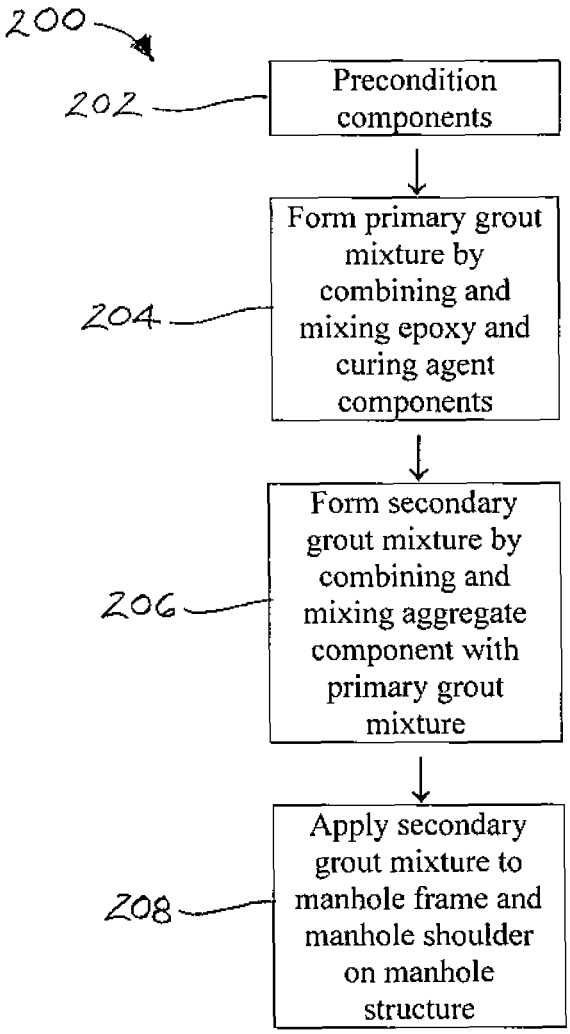
FIG. 8 is a flow diagram of a typical method of preparing the manhole frame grout according to an illustrative embodiment of the enhanced strength manhole cover assembly fabrication method.

Referring next to FIG. 8 of the drawings, a flow diagram of a typical method of preparing the manhole frame grout according to an illustrative embodiment of the enhanced strength manhole cover assembly fabrication method is generally indicated by reference numeral 200. At block 202, the epoxy resin, curing agent and aggregate components of the manhole frame grout may be preconditioned as was heretofore described. At block 204, a primary grout mixture may be formed by combining and mixing the epoxy and curing agent components. At block 206, a secondary grout mixture may be formed by combining and mixing an aggregate component with the primary grout mixture. At block 208, the secondary grout mixture may be applied to the manhole frame and the manhole shoulder on the manhole chimney of the manhole structure as was heretofore described with respect to block 106 in FIG. 7, after which the secondary grout mixture is cured to form the manhole frame grout (block 110 of FIG. 7).

While the embodiments of the disclosure have been described above, it will be recognized and understood that various modifications can be made and the appended claims are intended to cover all such modifications which may fall within the spirit and scope of the disclosure.

What is claimed is:

1. A manhole cover assembly for a manhole structure, comprising:
- a manhole structure;
- a manhole frame carried by the manhole structure;
- a manhole frame grout cementing the manhole frame to the manhole structure, the manhole frame grout including a grout mixture having:
  - an epoxy resin, comprising bisphenol A epoxy, bisphenol F epoxy and 1,4-butanediol diglycidyl ether;
  - a curing agent;
  - an aggregate; and
  - the epoxy resin and the aggregate are present in the grout mixture in an epoxy resin:aggregate weight ratio of about 0.09; and
- a removable manhole cover carried by the manhole frame.

2. The manhole cover assembly of claim 1 wherein the bisphel A epoxy, the bisphenol F epoxy and the 1,4-butanediol diglycidyl ether are present in the epoxy resin in percentages by weight of about 57.4%, about 24.6% and about 18%, respectively.

3. The manhole cover assembly of claim 1 wherein the curing agent comprises a modified polyamine.

4. The manhole cover assembly of claim 3 wherein the modified polyamine has an amine value of about 540-600 and a viscosity of about 150 MPas.

5. The manhole cover assembly of claim 1 wherein the aggregate comprises graded silica and fly ash.

6. The manhole cover assembly of claim 5 wherein the graded silica and the fly ash are present in the aggregate in percentages by weight of about 85% and about 15%, respectively.

7. The manhole cover assembly of claim 1 wherein the aggregate comprises about 80% by weight full grain silica, about 15% by weight fly ash and about 5% silica flour.

8. A manhole cover assembly for a manhole structure, comprising:
- a manhole shoulder;
- a manhole frame carried by the manhole shoulder;
- a manhole frame grout cementing the manhole frame to the manhole shoulder, the manhole frame grout including a grout mixture having:
  - about 8.75% by weight epoxy resin, comprising bisphenol A epoxy, bisphenol F epoxy and 1,4-butanediol diglycidyl ether;

about 3.25% by weight curing agent;

about 87.87% by weight aggregate; and the epoxy resin and the aggregate are present in the grout mixture in an epoxy resin:aggregate weight ratio of about 0.09; and a removable manhole cover carried by the manhole frame.

9. The manhole cover assembly of claim 8 wherein the bisphel A epoxy, the bisphenol F epoxy and the 1,4-butanediol diglycidyl ether are present in the epoxy resin in percentages by weight of about 57.4%, about 24.6% and about 18%, respectively.

10. The manhole cover assembly of claim 8 wherein the curing agent comprises a modified polyamine.

11. The manhole cover assembly of claim 10 wherein the modified polyamine has an amine value of about 540-600 and a viscosity of about 150 MPas.

12. The manhole cover assembly of claim 8 wherein the aggregate comprises graded silica and fly ash.

13. The manhole cover assembly of claim 12 wherein the graded silica and the fly ash are present in the aggregate in percentages by weight of about 85% and about 15%, respectively.

14. The manhole cover assembly of claim 8 wherein the aggregate comprises about 80% by weight full grain silica, about 15% by weight fly ash and about 5% silica flour.

15. A manhole cover assembly fabrication method, comprising:

preparing a grout mixture by combining and mixing an epoxy resin comprising bisphenol A epoxy, bisphenol F epoxy and 1,4-butanediol diglycidyl ether, a curing agent and an aggregate, the epoxy resin and the aggregate are present in the manhole frame grout in an epoxy resin:aggregate weight ratio of about 0.09;

placing a manhole frame on a manhole structure;

applying the grout mixture around the manhole frame and the manhole structure;

forming a manhole frame grout cementing the manhole frame to the manhole structure by curing the grout mixture; and placing a manhole cover in the manhole frame.

16. The manhole cover assembly fabrication method of claim 15 wherein preparing a grout mixture comprises combining and mixing about 8.75% by weight of the epoxy resin, about 3.25% by weight of the curing agent and about 87.87% by weight of the aggregate.

17. The manhole cover assembly fabrication method of claim 16 wherein preparing a grout mixture comprises combining and mixing the epoxy resin, the curing agent and the aggregate, with the epoxy resin including bisphel A epoxy, bisphenol F epoxy and 1,4-butanediol diglycidyl ether in percentages by weight of about 57.4%, about 24.6% and about 18%, respectively.

18. The manhole cover assembly fabrication method of claim 15 wherein preparing a grout mixture comprises combining and mixing the epoxy resin, the curing agent and the aggregate, with the curing agent including a modified polyamine having an amine value of about 540-600 and a viscosity of about 150 MPas.

19. The manhole cover assembly fabrication method 15 wherein preparing a grout mixture comprises combining and mixing the epoxy resin, the curing agent and the aggregate, with the aggregate including graded silica and fly ash.

20. The manhole cover assembly fabrication method of claim 19 wherein preparing a grout mixture comprises combining and mixing the epoxy resin, the curing agent and the aggregate, with the aggregate including a graded silica and fly ash present in the aggregate in percentages by weight of about 85% and about 15%, respectively.

21. The manhole cover assembly fabrication method of claim 20 wherein preparing a grout mixture comprises combining and mixing the epoxy resin, the curing agent and the aggregate, with the aggregate including about 80% by weight full grain silica, about 15% by weight fly ash and about 5% silica flour.

* * * * *